US007350674B2

(12) United States Patent
Hoglund

(10) Patent No.: US 7,350,674 B2
(45) Date of Patent: Apr. 1, 2008

(54) ARRANGEMENT FOR ADJUSTING ROTOR POSITION IN A ROTING SLUICE

(75) Inventor: Ronny Hoglund, Karlstad (SE)

(73) Assignee: Metso Fiber Karlstad AB (SE)

( * ) Notice: Subject to any disclaimer, the term of this patent is extended or adjusted under 35 U.S.C. 154(b) by 441 days.

(21) Appl. No.: 10/546,642

(22) PCT Filed: Mar. 3, 2004

(86) PCT No.: PCT/SE2004/000287

§ 371 (c)(1),
(2), (4) Date: Aug. 24, 2005

(87) PCT Pub. No.: WO2004/079086

PCT Pub. Date: Sep. 16, 2004

(65) Prior Publication Data

US 2006/0159551 A1 Jul. 20, 2006

(30) Foreign Application Priority Data

Mar. 5, 2003 (SE) ..... 0300581

(51) Int. Cl.
*D21C 7/06* (2006.01)

(52) U.S. Cl. ..... 222/368; 406/62; 414/219; 162/52

(58) Field of Classification Search ..... 222/367, 222/368, 444; 406/62–68; 414/217, 219–221; 48/48, 49; 162/52, 246
See application file for complete search history.

(56) References Cited

U.S. PATENT DOCUMENTS 2,161,553 A * 6/1939 Westberg et al. ..... 366/13
3,708,890 A * 1/1973 Weisselberg ..... 222/368
5,597,446 A * 1/1997 Sato et al. ..... 162/49

* cited by examiner

*Primary Examiner*—J. Casimer Jacyna
(74) *Attorney, Agent, or Firm*—Rolf Fasth; Fasth Law Offices

(57) ABSTRACT

The arrangement is for the adjustment of wear of the position of the rotor of a sluice feeder within a feed casing. The rotor has the form of a truncated cone and the play between the rotor and the surrounding casing is adjusted depending on the wear between the rotor and the casing through the rotor being axially displaced a predetermined displacement. A complete driving unit, motor and gear box are suspended on the journal of the rotor. The driving unit receives support from a torque support in the form of a beam fixed in the casing. The complete driving unit accompanies the rotor shaft during adjustment and makes contact with the torque-absorbing beam through sliding bearing supports.

7 Claims, 6 Drawing Sheets

ARRANGEMENT FOR ADJUSTING ROTOR POSITION IN A ROTING SLUICE

PRIOR APPLICATION

This application is a U.S. national phase application based on International Application No. PCT/SE2004/000287, filed 3 Mar. 2004, claiming priority from Swedish Patent Application No. 0300581-6, filed 5 Mar. 2003.

TECHNICAL FIELD

This application relates to an arrangement for adjusting a rotor position in a rotating sluice.

THE PRIOR ART

It is necessary in pulp mills to sluice chips and other lignocellulose material, such as cooking liquor or other treatment liquors, between lines and vessels that maintain different pressures. Thus chips are sluiced through what is known as a low-pressure feed into a steaming vessel in which a certain vapour pressure is maintained, usually between 150 and 200 KPa. The chips together with cooking liquor are sluiced after the steaming process via a highpressure feed into the high-pressure system of the digester, where a considerably higher pressure is maintained. A high-pressure feed, i.e. a sluice feeder intended for use with large pressure differences, of a conventional type is shown in FIG. 1 and FIG. 2. This feed corresponds to the type of feed revealed in SE,C,503684. It consists of a feed casing 1 and a rotor 2, also known as a tap. This tap is divided into a number of pockets 3 in order to sluice in chips through an inlet opening 4 and cooking fluid through an inlet opening 5 via an outlet opening 6 to the pulp digester. The shaft of the tap is denoted by the number 7. The general shape of the tap is that of a truncated cone, whose surface is denoted by the number 8. This tap is brought into contact with a correspondingly cone-shaped congruent surface 9 in the feed casing 1. The surfaces 8 and 9 are worn through friction between the surfaces 8 and 9 during rotation of the tap (means for achieving this rotation are not shown in the drawings). The setting of the tap must therefore be gradually adjusted by an axial displacement relative to the feed casing 1. Up until the middle of the 1990s, different manually adjustable screw arrangements in adjustment equipment attached to one end of the shaft 7 of the tap have been used for this adjustment. These arrangements have in common that they required relatively large forces to adjust them, while at the same time providing, in many cases, only limited accuracy of adjustment. Systems have been developed in order to adjust the position of the tap automatically.

For example, the Swedish patent SE,C,512305(=U.S. Pat. No. 5,597,446) describes such an arrangement, in which an automatic wear adjustment, which is also dependent on time, of the position of the tap is revealed. An electric motor is used in this case that presses the rotor shaft inwards by a regulatory distance of 0.03-0.4 mm at suitable intervals of time, from 3 times per day to once every four days.

The adjustment concept specified in SE,C,512305 has been installed at approximately 20 pulp mills, and the principle of its execution in practice is shown in FIG. 3. An electric motor 50 is used in this case, suspended on a ground-based frame 51. The tap shaft 7 is rotated through a reduction gear 52, this also being anchored to the ground-based frame, through a first connection 55 and a second connection 56. The connection 55 is a flexible connection that can absorb vibrations and oblique orientation between the driving unit and the shaft 7 of the tap, where the driving unit (motor and gear) is located in a support fixed to the ground and the feed casing 1 is allowed to have a certain flexibility. The second connection 56 and the shaft 7 of the tap are allowed through a splines connection (the female half of the splines connection is shown cross-hatched in the drawing) to move to the right in FIG. 3 during adjustment for wear.

Detection of the current rotational position is carried out through a toothed wheel 53 that is attached to the shaft of the motor, and by a sensor 54 on the support that detects the rotational position of the disk 53.

However, the adjustment servo as it is implemented as described in FIG. 3 will be relatively expensive since several different expensive connectors are required in order to connect the shafts between the driving unit that is attached to the ground and the shaft of the tap. In particular, the flexible connection is very expensive since it must be able to absorb the relatively large adjustment torque without any risk for play arising at the rotational position. Adjustment costs will also be unnecessarily high since installation of the adjustment servo requires on-site preparation during the completion of the ground-based frame.

PURPOSE AND AIM OF THE INVENTION

The present invention intends to offer a cheaper, better and considerably simpler adjustment servo for the compensation of wear in the sluice feeder. According to the invention, at least one connector and two expensive connections, relative to the previously known solution, can be eliminated. Preparations for installation and installation costs can be reduced to a minimum since a ground-based frame can be totally eliminated and the complete adjustment servo is instead suspended on the shaft of the tap with torque support in the feed casing. A splines connector can also be eliminated and replaced by a sliding bearing support that is fixed attached to the feed casing. In summary, an adjustment servo is obtained with the simplified design and the simplified installation procedure that costs only ⅓-⅕ of the equivalent cost for a previously known adjustment servo.

In contrast to the prior art, the complete driving package is suspended on the shaft of the tap and accompanies the educated sliding towards the sliding bearing support during adjustment of the position of the shaft of the tap.

DETAILED DESCRIPTION OF PREFERRED EMBODIMENTS

Figure 1:
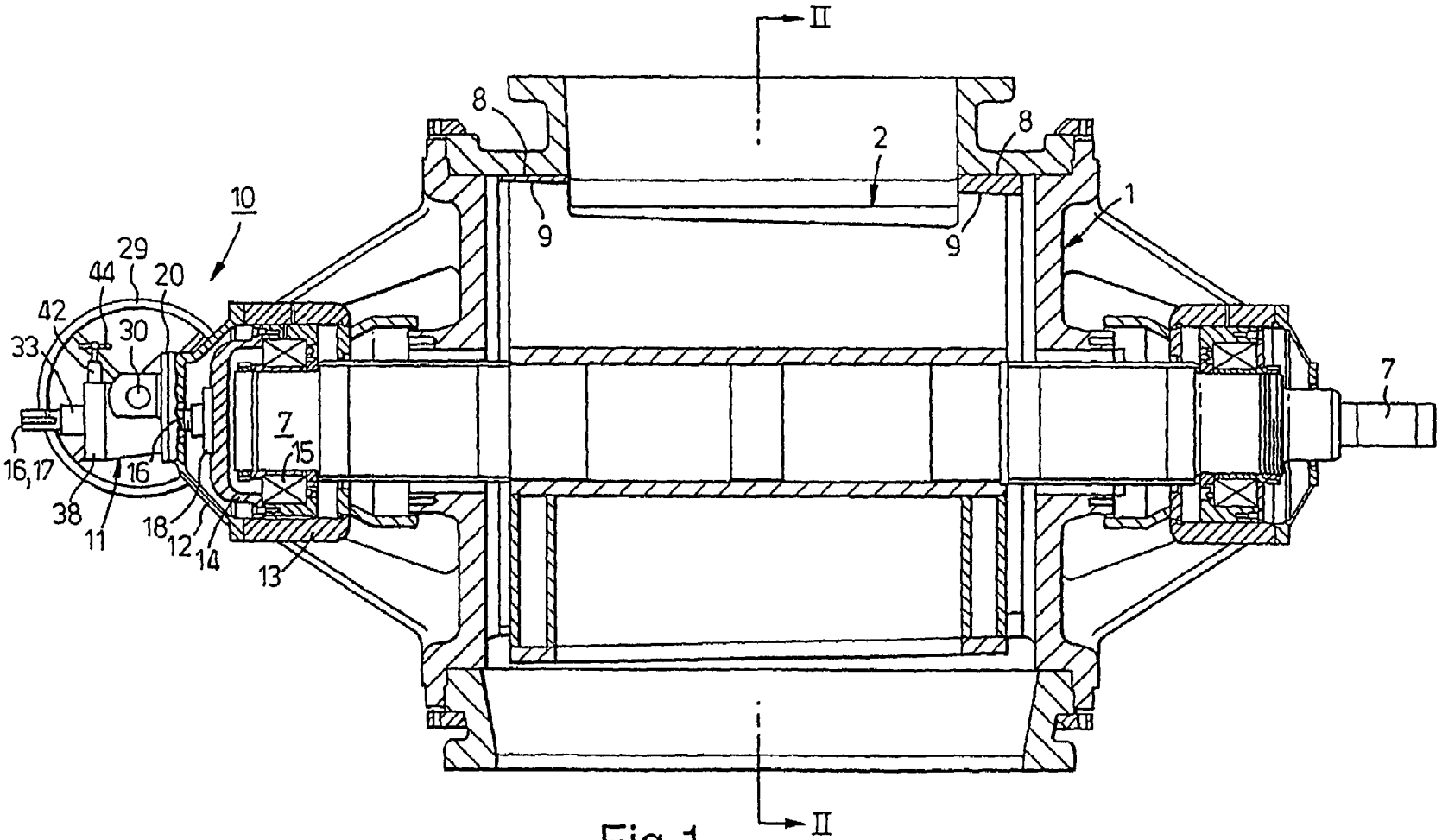
FIG. 1 shows the principle of operation of a known sluice feeder.
Figure 2:
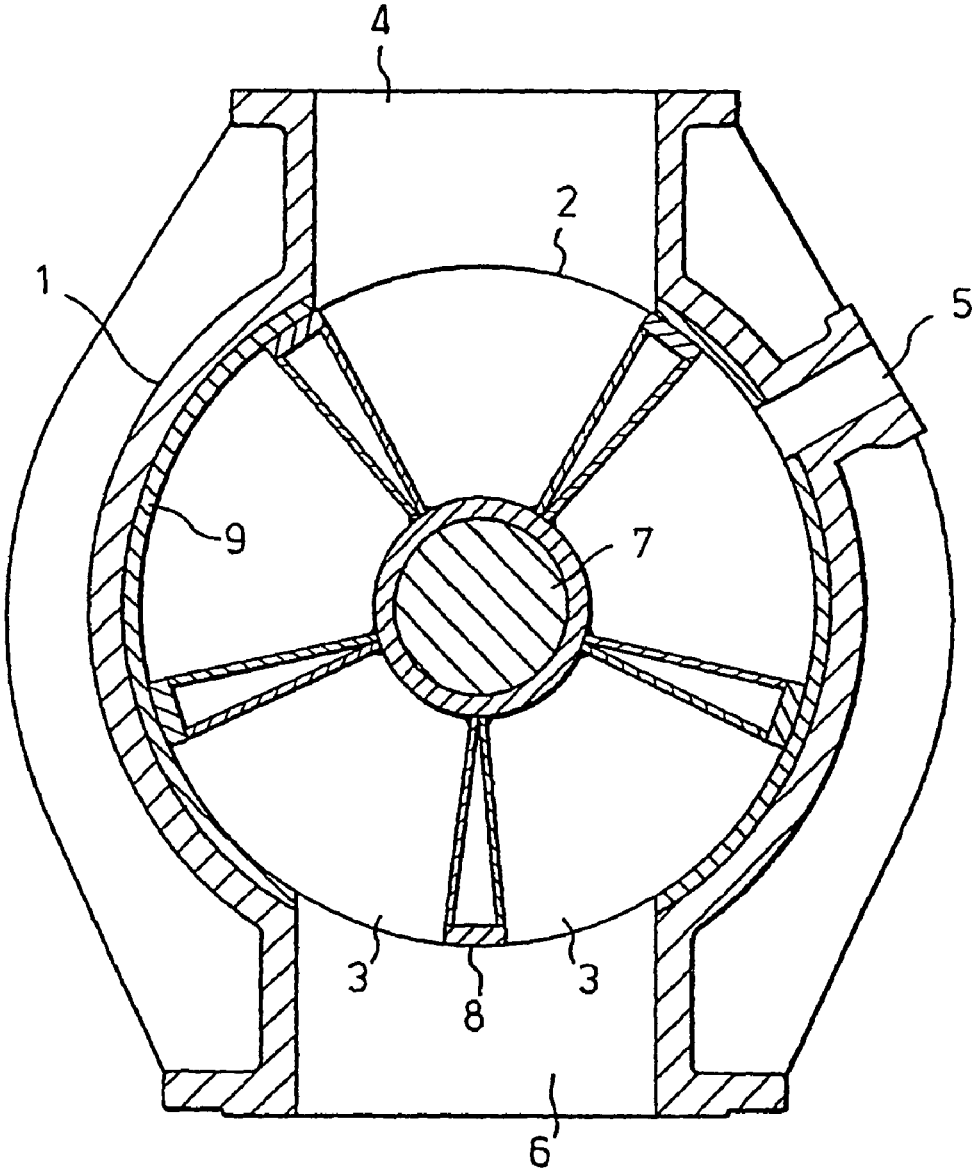
FIG. 2 shows a side view of the sluice feeder shown in FIG. 1.
Figure 3:
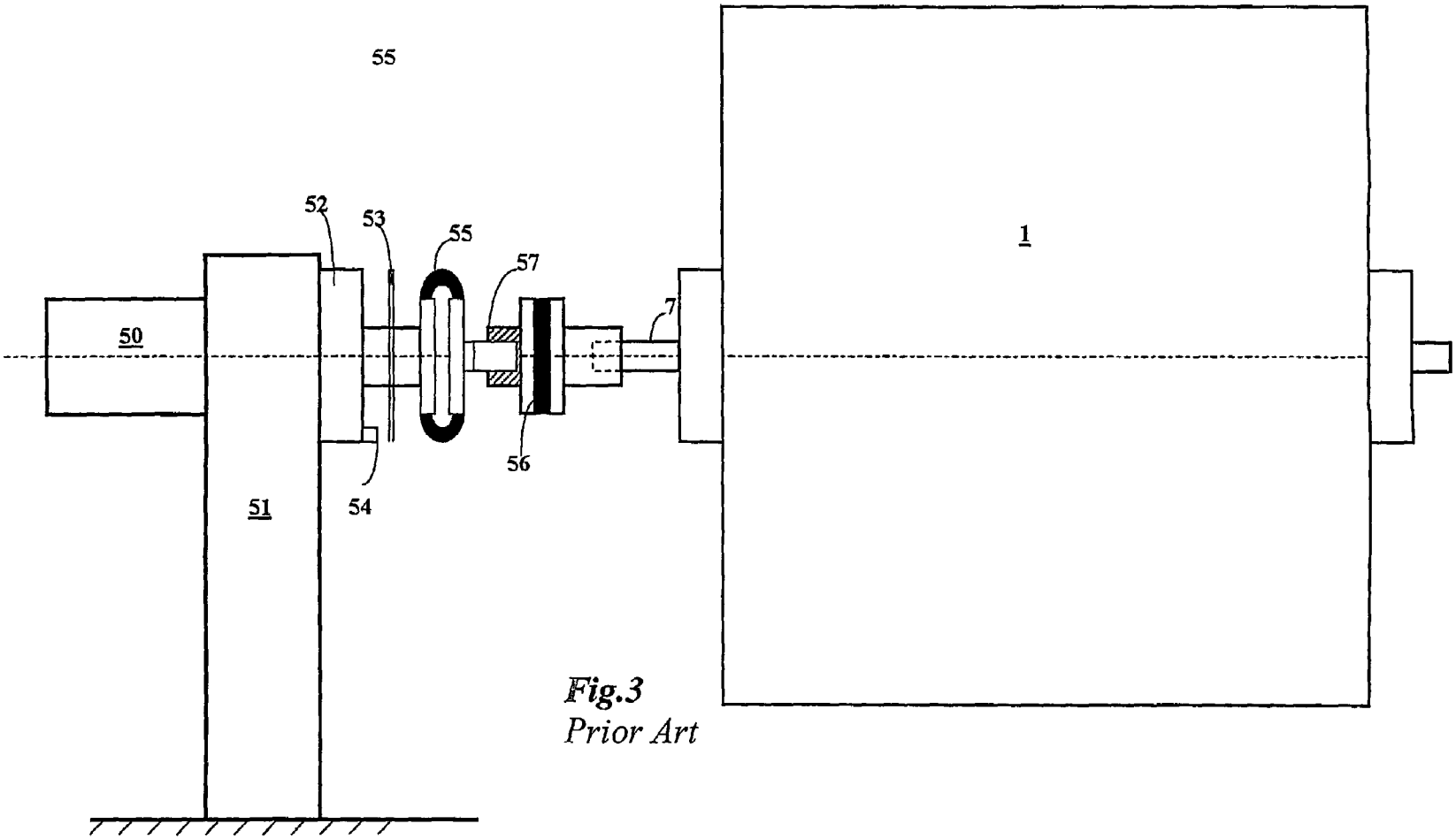
Fig.3 Prior Art
FIG. 3 shows how an adjustment servo of known design has been installed on a sluice feeder.

The invention concerns an arrangement for a sluice feederer equivalent to the one shown in FIG. 1 and as has been previously described.

The sluice feederer is arranged to sluice material from a first upper region 4 with lower pressure to a second lower region 6 with higher pressure, where the sluice feeder comprises a rotor 3 with a rotor shaft 7 arranged in a feed casing 1 where the rotor has the form of a truncated cone arranged with rotational symmetry around the rotor shaft 7 with at least two pockets 3 in the rotor that are open radially towards the perimeter, and where the inner surface of the feed casing has a conical form congruent with that of the rotor with an inlet connected to the first region 4 and an outlet connected to the second region 6, whereby a pocket on the rotor is initially filled with material from the first upper region and, following rotation of the rotor, delivers material to the second lower region.

The rotor is provided with an adjustment servo in a known manner for adjustment of the axial position of the rotor in the feed casing 1 in order to compensate for wear between the rotor and the feed casing hereby compensation of wear is obtained by adjustment of the axial position of the rotor such that play between the conical form of the rotor and the conical inner surface of the feed casing is reduced to a minimum.

The adjustment servo according to the invention is shown in different views in FIGS. 4, 5, 6 and 7, which adjustment servo comprises a driving unit 60 and a gear 61, which gear in this embodiment is a worm gear. The driving unit 60, 61 is arranged directly connected to the rotor shaft 7 without a ground-based frame for the driving unit, through a journal 63 and a shaft sleeve 64 fixed attached to the journal. The shaft sleeve 64 is fixed with respect to rotation to the rotor shaft with a conventional cotter joint. According to the invention, at least one fixed torque support (two torque supports 70*a*, 70*b* are shown in the drawings) is arranged in the feed casing 1, which torque support is arranged parallel to the rotor shaft 7 with an extent of the torque support from the feed casing 1 to the driving unit 60, 61, and that the driving unit makes contact with the torque support 70*a*, 70*b* when seen from the direction of rotation of the rotor/rotor shaft 7.

Figure 4:
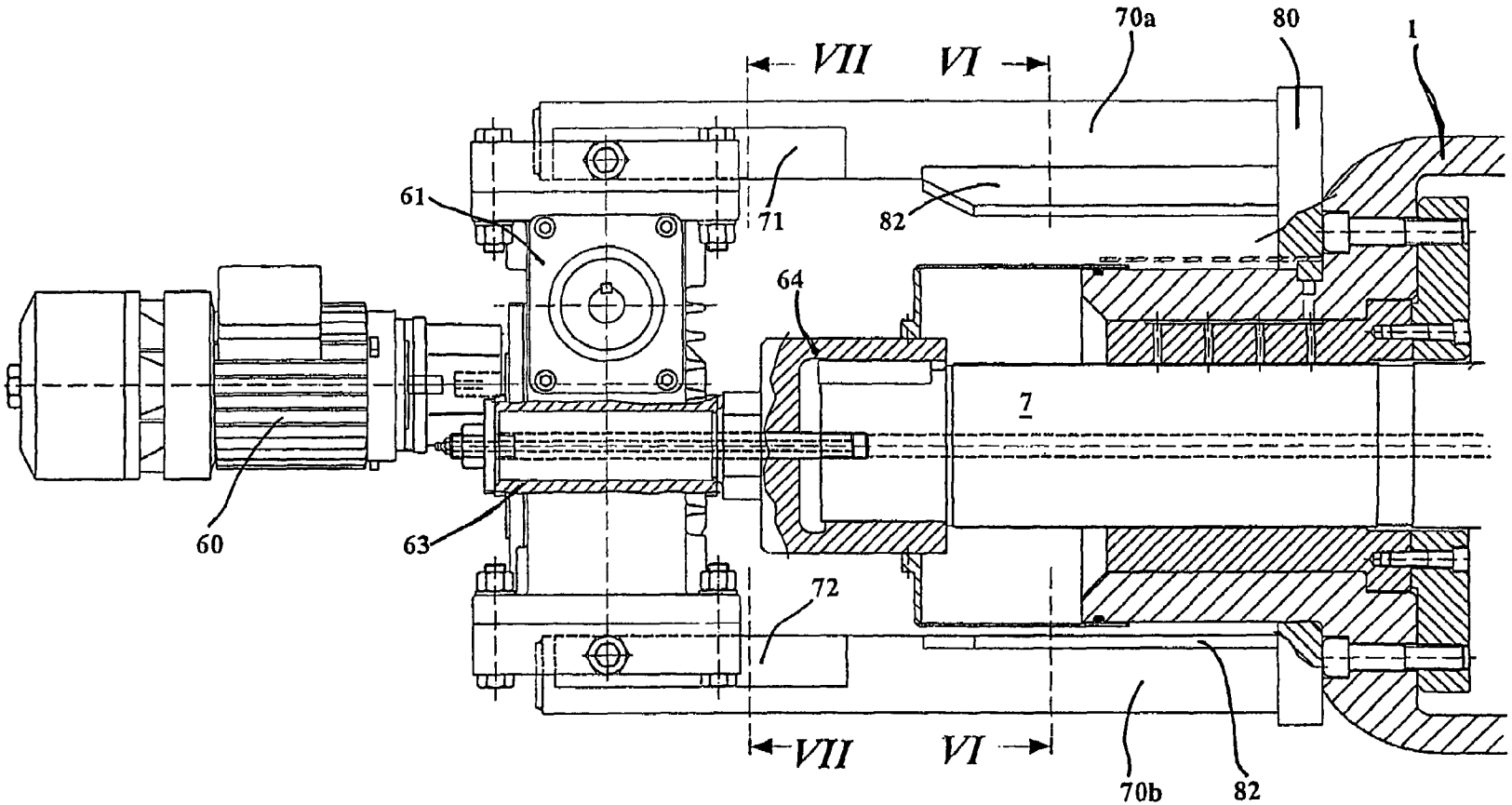
FIG. 4 shows a side view of the adjustment servo according to the invention.
Figure 5:
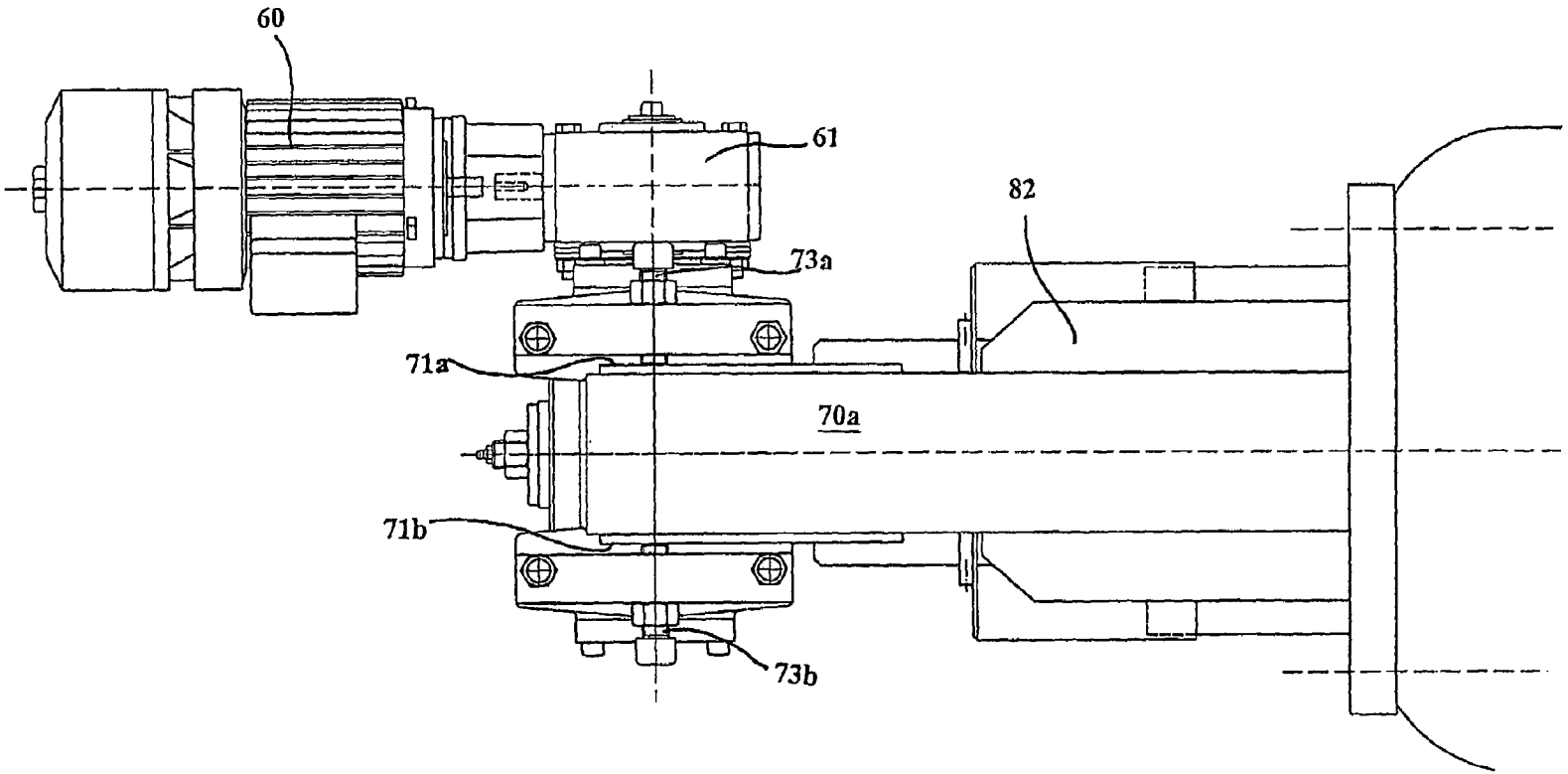
FIG. 5 shows a view of the adjustment servo according to the invention as seen from above in FIG. 4.
Figure 6:
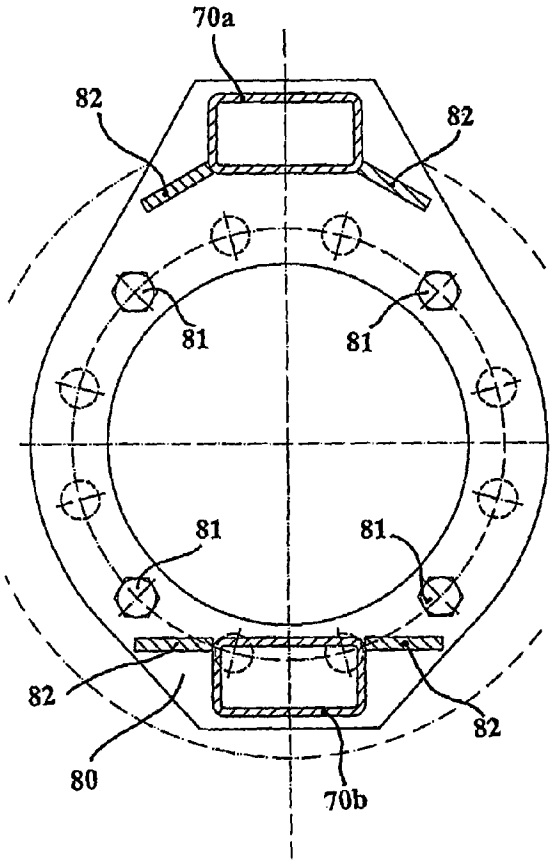
FIG. 6 shows a view of the adjustment servo according to the invention that is a cross-sectional view perpendicular to VI-VI in FIG. 4.
Figure 7:
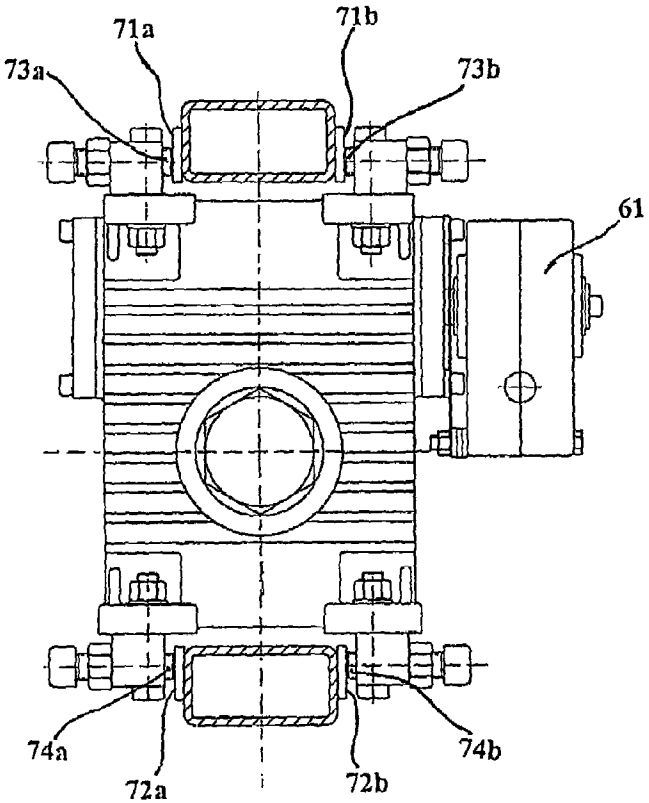
FIG. 7 shows a view of the adjustment servo according to the invention that is a cross-sectional view perpendicular to VII-VII in FIG. 4.

The torque support is constituted by at least one torsionally rigid beam 70*a*, 70*b*, fixed arranged in the feed casing, preferably a hollow beam as the cross-sectional views in FIG. 6 and FIG. 7 make clear. Each beam is fixed arranged, appropriately by welding, to the relevant end of the feed casing onto a flange 80 that is attached by screwing to the feed casing using attachment screws 81. FIG. 6 shows that the beams also have reinforcements 82 that, as is shown in FIGS. 4 and 5, extend a certain distance from the beam at the free end of the beam. The complete torque support is thus constituted only by the flange 80, the beams 70*a*, 70*b* and the reinforcements 82, which are mounted with attachment screws 81.

The torsionally rigid beam is designed to have an elongated surface of contact 71, 72 on the beam that is parallel with the rotor shaft. In the embodiment shown, there are two torque supports in the form of torsionally rigid beams, which are arranged at a distance, in the embodiment shown at equal distances, from the centre of the rotor shaft 7, and where each beam is located arranged on opposite sides of the centre of the rotor shaft.

Naturally, a different number of torque supports than two may be used, for example three torque supports, which are then appropriately arranged essentially evenly distributed around the rotor shaft, preferably with 120 degrees between the torque supports in the direction around the rotor shaft. As FIG. 5 makes clear, each beam 70*a*, 70*b* is designed with two parallel elongated contact surfaces 71*a* and 71*b* on both sides of the beam. In order for the driving unit to be able to absorb torque relative to the feed housing, the driving unit 60, 61 is designed with a sliding support 73*a*, 73*b* and 74*a*, 74*b* that makes contact with the elongated contact surface of the beam. In the embodiment shown, these are constituted by the end surfaces of an adjustment screw.

The sliding support 73*a*, 73*b* and 74*a*, 74*b* straddles, in the embodiment shown, the interacting torque-absorbing beam and makes contact with the elongated contact surfaces on each side of the beam. Absorption of torque can in this way take place in both directions without any play arising.

In the embodiment shown, where the sliding support is in the form of the end surfaces of adjustment screws, it is easy to adjust the play between the sliding support of the driving unit and the elongated contact surface of each beam, and to lock the adjustment screws with the locking nut shown.

The complete driving unit will accompany the axial displacement of the rotor shaft during adjustment, while the sliding supports slide along the contact surfaces of the beam or beams 70*a*, 70*b*.

In accordance with the adjustment known from SE,C, 512305 (=U.S. Pat. No. 5,597,446), an automated adjustment of wear can take place on the basis of time, in this case suitably with an adjustment magnitude of 0.03-0.4 mm, as often as an adjustment three times per day and up to an adjustment of once per four days. However, this method of adjustment has proven to be unsuitable and insensitive to changes in the process, since wear in the sluice feeder is far from uniform over a period of time, and depends on the tendency of the material being fed in at any moment to wear down the play between the rotor and the feed casing. Using strictly time-based adjustment, a displacement of the rotor is most often initiated at times when it is not justified, something that means that the sluice feeder is adjusted with too little play, giving not only an increased motor torque, which results in increased operating costs, but also increased wear on the sluice feeder (both rotor and casing). It is preferable that the adjustment be carried out in an adaptive manner depending on a parameter of the sluice feeder that depends on operation, and that is indicative of the degree of wear. This parameter can be constituted by one or several of the following parameters.

Parameter No. 1

The motor torque for driving the rotor of the sluice feeder. By monitoring the motor torque at a pre-determined production (rpm of the rotor), an adjustment can be initiated as soon as the motor torque constantly falls below a predetermined threshold value during a certain minimum period. It is appropriate if the threshold value is set at a motor torque that lies 5-10% under the nominal motor torque, which nominal motor torque corresponds to the torque required at the relevant rate of revolution and initially measured play between the rotor and the casing. It is appropriate that torque measurement at the shaft or a torque measurement of the driving motor is used for detection of the motor torque, by detection of the instantaneous current supply to the electric motor (for a motor having a controlled rate of revolution).

Parameter No. 2

Sluice feeders of the relevant type most often have a return flow to the sluice feeder in order to compensate for increased wear, and in this way also for leakage of cooking liquor. An adjustment can be initiated by monitoring this return flow, as soon as the flow exceeds a pre-determined threshold value during a certain minimum period. It is appropriate that the threshold value is set to be a flow that lies 10-20% above the nominal flow, which corresponds to the flow required at the relevant rate of revolution and initially measured play between the rotor and the casing.

A feedback-controlled initiation of adjustment using a parameter that indicates wear allows each adjustment to be much smaller, since a subsequent detection of the parameter can be carried once the adjustment has been made. If the relevant parameter still indicates that the wear is too large, a new adjustment can be made after only a few minutes, preferably at least 10 minutes after the previous adjustment. The desired nominal value can be used instead of the threshold value during such a repeated adjustment, if adjustment back to the optimal situation is desired.

While the present invention has been described in accordance with preferred compositions and embodiments, it is to be understood that certain substitutions and alterations may be made thereto without departing from the spirit and scope of the following claims.

The invention claimed is:

1. A position-adjusting arrangement for a rotor in a sluice feeder, comprising:

a sluice feeder being arranged to sluice material from a first upper region at a lower pressure to a second lower region at a higher pressure, the sluice feeder having a rotor with a rotor shaft arranged in a feed casing, the rotor having a conical form of a truncated cone arranged with rotational symmetry around the rotor shaft with at least two pockets in the rotor that are open radially towards a perimeter, an inner surface of the feed casing having a shape that is congruent with that of the rotor, an inlet (4) connected to a first upper region and an outlet (6) connected to a second lower region, one pocket of the rotor is initially filled with a material from the first upper region and, following rotation of the rotor, delivers the material to the second lower region, the rotor is being equipped with an adjustment servo for adjusting an axial position of the rotor in the feed casing in order to compensate for wear between the rotor and the feed casing by adjustment of the axial position of the rotor such that a play between the conical form of the rotor and the inner surface of the feed casing is minimized, the adjustment servo having a driving unit with a motor and a gear, the driving unit is being arranged to be connected to the rotor shaft without ground-support for the driving unit, a torque support being fixedly arranged in the feed casing, the torque support being arranged in parallel to the rotor shaft with an extension of the torque support from the feed casing and to the driving unit, and the driving unit being in contact with the torque support.

2. The position-adjusting arrangement according to claim 1 wherein the torque support is constituted by at least one torsionally rigid beam fixedly arranged in the feed casing, the beam has an elongated surface of contact that is parallel with the rotor shaft.

3. The position-adjusting arrangement according to claim 2 wherein the torque support is constituted by two torsionally rigid beams arranged at a distance from a center of the rotor shaft, and the two beams are located on opposite sides of the center of the rotor shaft.

4. The position-adjusting arrangement according to claim 2 wherein each beam respectively on opposite sides of the beam has two elongated parallel surfaces of contact.

5. The position-adjusting arrangement according to claim 2 wherein the driving unit has a slide support that makes contact with the elongated parallel surfaces of the beam.

6. The position-adjusting arrangement according to claim 5 wherein the driving unit has a slide support that straddles the beam, and that makes contact with the elongated parallel surfaces of the beam.

7. The position-adjusting arrangement according to claim 6 wherein the slide support has adjustment means for adjusting the play between the slide support of the driving unit and the elongated parallel surfaces of each beam.

* * * * *

US007350674C1

(12) INTER PARTES REEXAMINATION CERTIFICATE (554th)

United States Patent
Hoglund

(10) Number: US 7,350,674 C1
(45) Certificate Issued: Mar. 12, 2013

(54) ARRANGEMENT FOR ADJUSTING ROTOR POSITION IN A ROTING SLUICE

(75) Inventor: Ronny Hoglund, Karlstad (SE)

(73) Assignee: Metso Paper Sweden Aktiebolag, Sundsvall (SE)

Reexamination Request:
No. 95/001,771, Nov. 4, 2011

Reexamination Certificate for:

| | |
|---|---|
| Patent No.: | **7,350,674** |
| Issued: | **Apr. 1, 2008** |
| Appl. No.: | **10/546,642** |
| Filed: | **Aug. 24, 2005** |

(21) Appl. No.: 95/001,771

(22) PCT Filed: Mar. 3, 2004

(86) PCT No.: PCT/SE2004/000287

§ 371 (c)(1),
(2), (4) Date: Aug. 24, 2005

(87) PCT Pub. No.: WO2004/079086

PCT Pub. Date: Sep. 16, 2004

(30) Foreign Application Priority Data

Mar. 5, 2003 (SE) ..... 0300581

(51) Int. Cl.
*D21C 7/06* (2006.01)

(52) U.S. Cl. ..... 222/368; 162/52; 406/62; 414/219

(58) Field of Classification Search ..... None
See application file for complete search history.

(56) References Cited

To view the complete listing of prior art documents cited during the proceeding for Reexamination Control Number 95/001,771, please refer to the USPTO's public Patent Application Information Retrieval (PAIR) system under the Display References tab.

*Primary Examiner* — Patricia Engle

(57) ABSTRACT

The arrangement is for the adjustment of wear of the position of the rotor of a sluice feeder within a feed casing. The rotor has the form of a truncated cone and the play between the rotor and the surrounding casing is adjusted depending on the wear between the rotor and the casing through the rotor being axially displaced a predetermined displacement. A complete driving unit, motor and gear box are suspended on the journal of the rotor. The driving unit receives support from a torque support in the form of a beam fixed in the casing. The complete driving unit accompanies the rotor shaft during adjustment and makes contact with the torque-absorbing beam through sliding bearing supports.

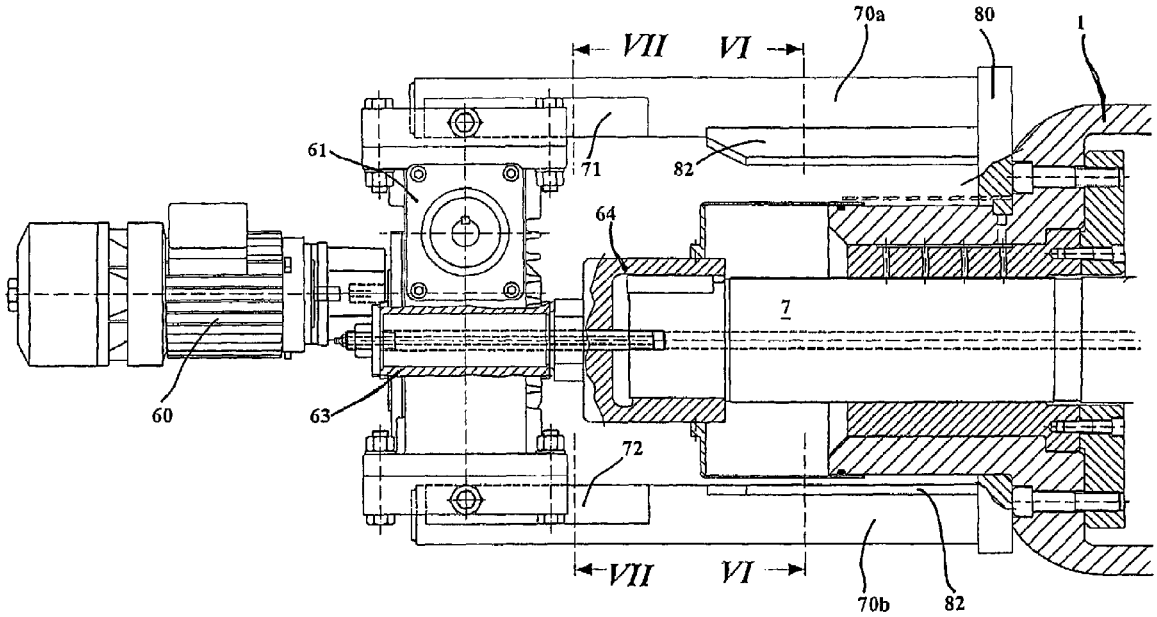

INTER PARTES REEXAMINATION CERTIFICATE ISSUED UNDER 35 U.S.C. 316

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

Claim 2 is cancelled.

Claims 1 and 3-5 are determined to be patentable as amended.

Claims 6 and 7 were not reexamined.

1. A position-adjusting arrangement for a rotor in a sluice feeder, comprising:

a sluice feeder being arranged to sluice material from a first upper region at a lower pressure to a second lower region at a higher pressure, the sluice feeder having a rotor with a rotor shaft arranged in a feed casing, the rotor having a conical form of a truncated cone arranged with rotational symmetry around the rotor shaft with at least two pockets in the rotor that are open radially towards a perimeter, an inner surface of the feed casing having a shape that is congruent with that of the rotor, an inlet [(4)] connected to a first upper region and an outlet [(6)] connected to a second lower region, one pocket of the rotor is initially filled with a material from the first upper region and, following rotation of the rotor, delivers the material to the second lower region, the rotor is being equipped with an adjustment servo for adjusting an axial position of the rotor in the feed casing in order to compensate for wear between the rotor and the feed casing by adjustment of the axial position of the rotor such that a play between the conical form of the rotor and the inner surface of the feed casing is minimized, the adjustment servo having a driving unit with a motor and a gear, the driving unit is being arranged to be connected to the rotor shaft without ground-support for the driving unit, a torque support being fixedly arranged in the feed casing, the torque support being arranged in parallel to the rotor shaft with an extension of the torque support from the feed casing and to the driving unit, and the driving unit being in contact with the torque support*, and*

*the torque support is constituted by at least one torsionally rigid beam fixedly arranged in the feed casing, the beam has an elongated surface of contact that is parallel with the rotor shaft*.

3. The position-adjusting arrangement according to claim [2] *1* wherein the torque support is constituted by two torsionally rigid beams arranged at a distance from a center of the rotor shaft, and the two beams are located on opposite sides of the center of the rotor shaft.

4. The position-adjusting arrangement according to claim [2] *1* wherein each beam respectively on opposite sides of the beam has two elongated parallel surfaces of contact.

5. The position-adjusting arrangement according to claim [2] *1* wherein the driving unit has a slide support that makes contact with the elongated parallel surfaces of the beam.

* * * * *